US011091302B2

(12) United States Patent
Schuler et al.

(10) Patent No.: US 11,091,302 B2
(45) Date of Patent: Aug. 17, 2021

(54) CONTAINER SYSTEM WITH BASE AND FOLDABLE LID

(71) Applicant: Sabert Corporation, Sayrevillle, NJ (US)

(72) Inventors: Jason S. Schuler, Maplewood, NJ (US); Yohanan Siskindovich, Glen Ridge, NJ (US)

(73) Assignee: SABERT CORPORATION, Sayreville, NJ (US)

( * ) Notice: Subject to any disclaimer, the term of this patent is extended or adjusted under 35 U.S.C. 154(b) by 53 days.

(21) Appl. No.: 16/795,248

(22) Filed: Feb. 19, 2020

(65) Prior Publication Data

US 2020/0262620 A1 Aug. 20, 2020

Related U.S. Application Data

(60) Provisional application No. 62/807,532, filed on Feb. 19, 2019.

(51) Int. Cl.

| | |
|---|---|
| ***B65D 43/16*** | (2006.01) |
| ***B65D 21/02*** | (2006.01) |
| ***B65D 43/02*** | (2006.01) |
| ***B65D 8/00*** | (2006.01) |

(52) U.S. Cl.

CPC ..... *B65D 43/161* (2013.01); *B65D 11/02* (2013.01); *B65D 21/0206* (2013.01); *B65D 43/0208* (2013.01); *B65D 2543/00379* (2013.01)

(58) Field of Classification Search

CPC .. B65D 43/161; B65D 43/16; B65D 43/0214; B65D 43/0208; B65D 43/0204; B65D 43/02; B65D 39/16; B65D 51/18

USPC ..... 220/254.3, 254.1, 259.2, 259.1, 256.1, 220/832, 831, 810, 826, 805, 802, 801, 220/796

See application file for complete search history.

(56) References Cited

U.S. PATENT DOCUMENTS

| | | | | |
|---|---|---|---|---|
| 6,523,713 | B1 * | 2/2003 | Helms | B65D 51/20 220/831 |
| 7,150,380 | B2 * | 12/2006 | Hoepner | B65D 43/161 222/480 |
| 9,809,356 | B2 * | 11/2017 | Kissner | B65D 43/0212 |
| 2008/0190951 | A1 * | 8/2008 | Gallagher | B65D 43/021 220/826 |
| 2012/0279969 | A1 * | 11/2012 | Antal, Sr. | B65D 47/0847 220/315 |

* cited by examiner

*Primary Examiner* — Robert J Hicks
(74) *Attorney, Agent, or Firm* — Cozen O'Connor

(57) ABSTRACT

A container system, including a base with a rim having a pair of protrusions on opposite sides of the base extending into the base; and a lid having a peripheral outer rim. The lid includes a pair of partial peripheral troughs positioned radially inward of the outer rim, ends of the partial peripheral troughs being spaced apart to form a pair of peripheral gaps on opposite sides of the lid to receive the pair of protrusions of the base to attach the lid to the base. The lid has a hinge about which the lid folds as a first part of the lid is lifted to provide access to the interior volume of the base while a second part of the lid on an opposite side of the hinge remains attached to the base.

20 Claims, 10 Drawing Sheets

CONTAINER SYSTEM WITH BASE AND FOLDABLE LID

CROSS-REFERENCE TO RELATED APPLICATION

This application claims benefit under 35 U.S.C. § 119(e) of U.S. Provisional Patent Application No. 62/807,532, filed Feb. 19, 2019, the entirety of which is incorporated by reference herein.

BACKGROUND

Field of the Invention

The disclosed embodiments are directed to a container system having a base and a lid that folds as a first part of the lid is lifted to provide access to the interior volume of the base while a second part of the lid on an opposite side remains attached to the base.

Description of the Related Art

Food storage containers have become increasingly prevalent in a busy society. More and more people are eating on the go and even in their cars. Eating on the go, however, creates unique problems with traditional food storage containers that have yet to be addressed. For example, food storage containers typically comprise a base and lid which are formed of transparent or translucent plastic and which are attachable to and detachable from each other. In particular, a closed container requires the lid to be fully separated from the base to provide access to the container contents. For people eating on the go, this can make it difficult to consume the contents and also presents unwanted opportunity for spillage and contamination. Moreover, additional space is needed for placement of the separated container lid, such as on a passenger seat of a vehicle, on the vehicle floor and the like. The requirement for such additional space for the separated lid is a further drawback of existing container systems. There is a need for an improved food container—particularly in an age when more and more restaurants seek to increase sales through online and take-out business—to enhance consumer on the go dining experience.

SUMMARY OF THE INVENTION

Disclosed embodiments are directed to a container system comprising a base and a friction-fit (e.g., snap-fit) lid attachable to the base. The components can be configured in, but are not limited to, a circle or oval shape as well as any rectilinear shape. The embodiments described herein provide a food container that can maintain its footprint in its closed position and in a partially opened configuration while being used in both hot and cold food applications.

The system includes at least one container base and a lid. The lid is configured to be securely and detachably joined to the base about the periphery of the base in a press-fit arrangement. The lid is also configured to be partially opened in a folded configuration along a hinge to provide access to the container content through the opened section of the lid. This is accomplished by providing at least a pair of opposing bosses (or protrusions) formed on an inside of a base wall at the periphery of the base. Mating features are present on an underside of the lid in which the bosses are secured in a press fit arrangement. The bosses and mating features are positioned at each end of the hinge such that a portion of the lid away from the bosses can be separated from the base, thereby providing a foldable "flap", i.e., a portion of the lid which can be opened while the remainder of the lid remains attached to the base. In this manner, access to the container contents is provided through either one side or the other side of the lid.

The bosses across which the lid folds can be diametrically opposite each other or positioned at a cord located at one third, one quarter, or other dimensions of the lid. In this manner, one portion of the lid can be opened to provide a consumer with access to the container content, or another portion of the lid can be opened to provide access to the container contents. Moreover, if a dividing wall is present in the container base to form internal compartments, then each section of the lid provides access to the contents of the compartment below that lid section. The compartments may be configured in a number of ways including but not limited to half-and-half split or a one-third-two-thirds split.

The folding lid of the disclosed embodiments may also include a boss or protrusion on one region of the hinged portion of the lid and an opening directly opposite the boss within which the boss is received when one side of the lid is fully opened, thereby allowing the opened portion of the lid to affix in a flat position to the secured portion of the lid.

The embodiments described herein provide ease of operation. The hinge on the lid and positioned bosses in the base are intuitive to use and require little to no training. Closing and opening the lid requires little force.

A container system may be summarized as including a base having a bottom and one or more sidewalls extending from the bottom to define an interior volume, the base having a rim at a peripheral edge of the one or more sidewalls, the rim having a pair of protrusions on opposite sides of the base extending into the base; and a lid having a peripheral outer rim, the lid comprising a pair of partial peripheral troughs positioned radially inward of the outer rim, ends of the partial peripheral troughs being spaced apart to form a pair of peripheral gaps on opposite sides of the lid to receive respective ones of the pair of protrusions of the base to attach the lid to the base, the lid having a hinge about which the lid folds as a first part of the lid is lifted to provide access to the interior volume of the base while a second part of the lid on an opposite side of the hinge remains attached to the base.

Embodiments of the container system may include one or more of the following features.

The hinge may extend across a width of the lid in alignment with the pair of peripheral gaps. The first part of the lid may form an interference fit with a first portion of the rim of the base and the pair of protrusions of the base, and the second part of the lid may form an interference fit with a second portion of the rim of the base and the pair of protrusions of the base. The pair of protrusions of the base may extend along at least a portion of the sidewalls toward the bottom of the base. Each gap of the pair of peripheral gaps of the lid may include a first side surface and an opposing second side surface which are sized and shaped so that each protrusion of the pair of protrusions of the base forms an interference fit with both the first side surface and the second side surface of a respective one of the pair of peripheral gaps when the lid is attached to the base. When the lid folds as the first part of the lid is lifted to provide access to the interior volume of the base, the first side surface of each said gap of the pair of peripheral gaps may lose contact with a respective one of the pair of protrusions of the base, while the second side surface of each said gap of the pair of peripheral gaps maintains an interference fit with the respective one of the pair of protrusions of the base.

The lid may include a lock to removably attach the first part of the lid to the second part of the lid when the lid is folded to a position in which a top surface of the first part of the lid meets a top surface of the second part of the lid. The lock may include an upward protrusion on one of the first part of the lid and the second part of the lid and an indent to receive the protrusion on the other of the first part of the lid and the second part of the lid.

The base may be a substantially round or substantially oval bowl formed of plastic and the lid may have a corresponding round or oval shape and may be formed of plastic. The base may be substantially rectangular or substantially square and may be formed of plastic and the lid may have a corresponding substantially rectangular or substantially square shape and is formed of plastic.

The container system may include a dividing wall to divide the base into sections, the dividing wall extending across a width of the base between the pair of protrusions of the rim on opposite sides of the base. The dividing wall may have a rim which is continuous with the pair of protrusions of the rim on opposite sides of the base and the rim of the base and the wall may be formed at least in part by a protrusion extending from a bottom of the base which divides the base into two portions with a gap therebetween.

In another aspect, a container system may be summarized as including a base having a bottom and one or more sidewalls extending from the bottom to define an interior volume, the base having a rim at a peripheral edge of the one or more sidewalls, the rim having a pair of protrusions on opposite sides of the base extending into the base; and a lid having a peripheral outer rim, the lid having a first part and a second part divided by a hinge about which the lid folds, the first part of the lid and the second part of the lid each independently forming an interference fit with the pair of protrusions of the base to attach the lid to the base so that as one of the first part and the second part of the lid is lifted to provide access to the interior volume of the base, the other of the first part and the second part of the lid remains attached to the base.

Embodiments of the container system may include one or more of the following features.

The first part of the lid may form an interference fit with a first portion of the rim of the base and the pair of protrusions of the base, and the second part of the lid may form an interference fit with a second portion of the rim of the base and the pair of protrusions of the base. The first part of the lid may form an interference fit with one side of each protrusion of the pair of protrusions of the base, and the second part of the lid may form an interference fit with an opposite side of each protrusion of the pair of protrusions of the base. The lid may have a lock to removably attach the first part of the lid to the second part of the lid when the lid is folded to a position in which a top surface of the first part of the lid meets a top surface of the second part of the lid. The lock may have an upward protrusion on one of the first part of the lid and the second part of the lid and an indent to receive the protrusion on the other of the first part of the lid and the second part of the lid. The pair of protrusions of the base may extend along at least a portion of the one or more sidewalls toward the bottom of the base. The base may be a substantially round or substantially oval bowl formed of plastic and the lid may have a corresponding round or oval shape and is formed of plastic. The base may be substantially rectangular or substantially square and may be formed of plastic and the lid may have a corresponding substantially rectangular or substantially square shape and is formed of plastic.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements are arbitrarily enlarged and positioned to improve drawing legibility. Further, the particular shapes of the elements as drawn, are not necessarily intended to convey any information regarding the actual shape of the particular elements, and have been solely selected for ease of recognition in the drawings.

DETAILED DESCRIPTION OF THE EMBODIMENTS

Figure 1:
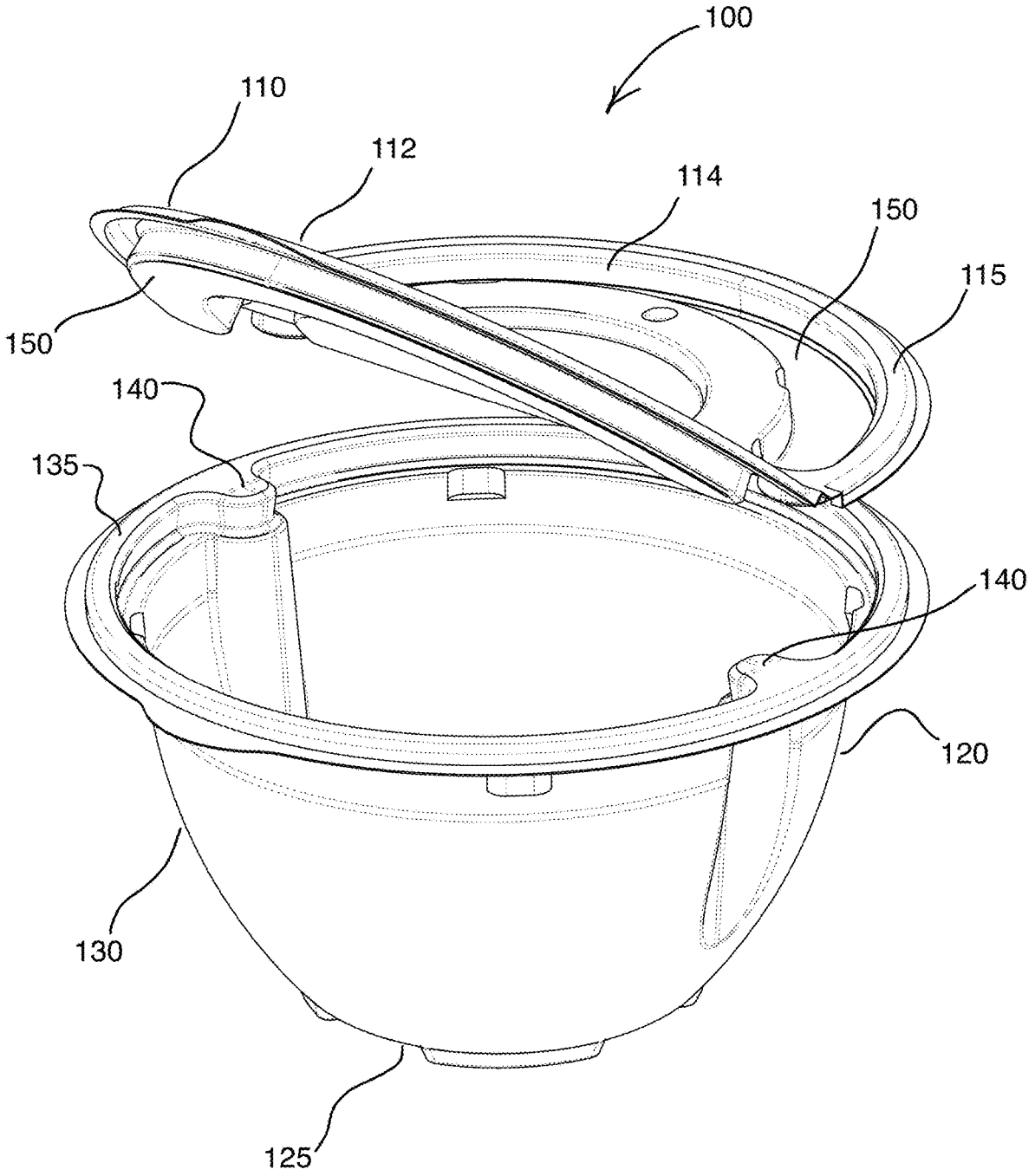
FIG. 1 is a perspective view of a container system having a foldable lid and a base, the lid unattached to the base and partially folded, according to at least one illustrated implementation.
Figure 2:
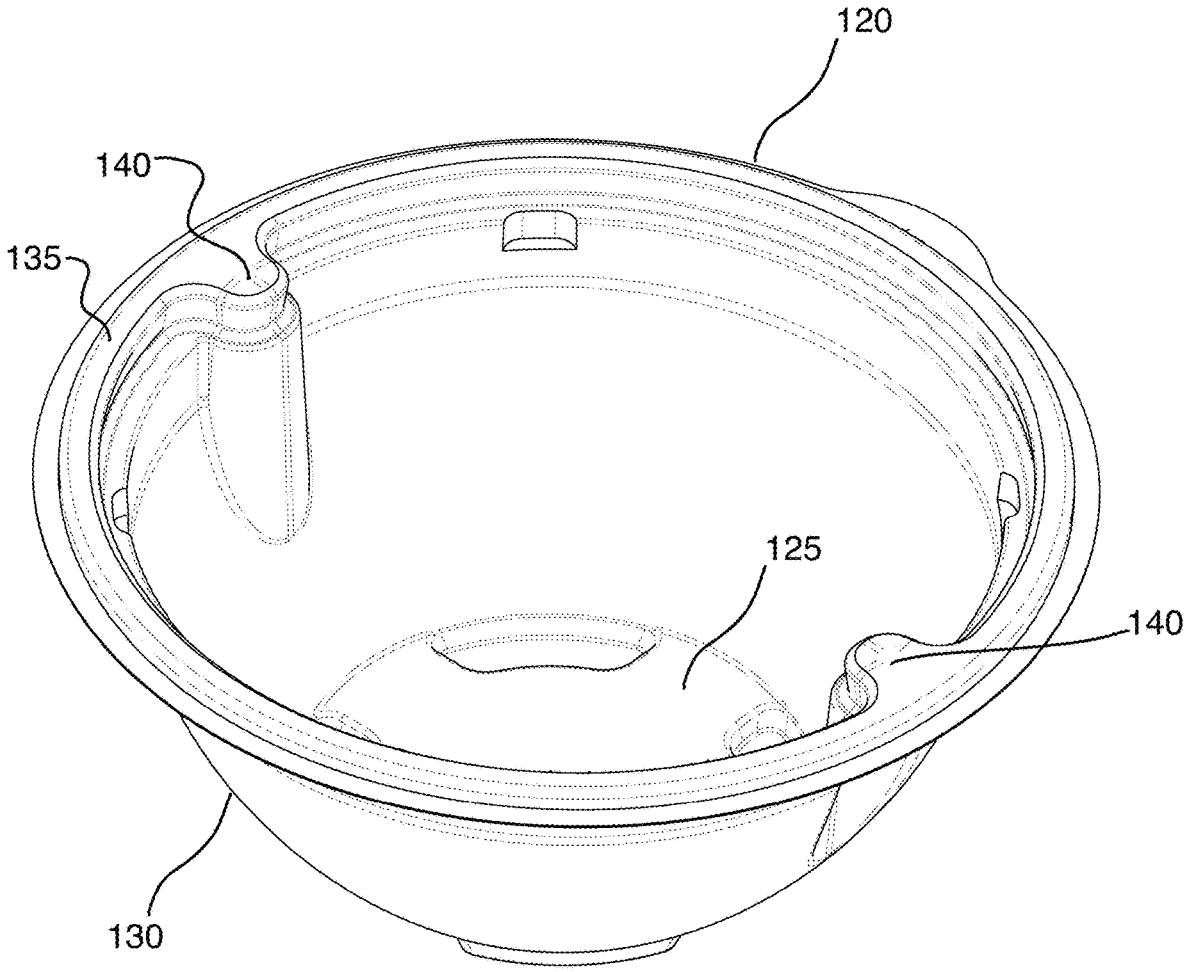
FIG. 2 is a perspective view of the base of the container system of FIG. 1, according to at least one illustrated implementation.

FIG. 1 is a perspective view of a container system 100 having a foldable lid 110 and a base 120. The lid 110 is unattached to the base 120 and partially folded in the example depicted. FIG. 2 is a perspective view of the base 120 of the container system 100. The base 120 has a bottom 125 and one or more sidewalls (e.g., sidewall 130) extending from the bottom 125 to define an interior volume. In the example depicted, the base 120 is substantially round and therefore can be said to have a single circumferential sidewall 130. Other shapes for the base 120 are also possible, such as, for example, square, oval, or rectangular (a square or rectangular base can be said to have four sidewalls), with the lid 110 having a corresponding shape.

The base 120 has a rim 135 at a peripheral upper edge of the sidewall 130. The rim 135 has a pair of protrusions 140 on opposite sides of the base 120 extending into the base 120. The pair of protrusions 140 may extend along at least a portion of the sidewall 130 toward the bottom 125 of the base 120. In implementations, the base 120 may be made in a thermoforming process, in which case the mold used to form the base 120 may have convex formations on opposites sides which cause the formation of an indentation, from the exterior toward the interior, on each side of the base 120.

Figure 3:
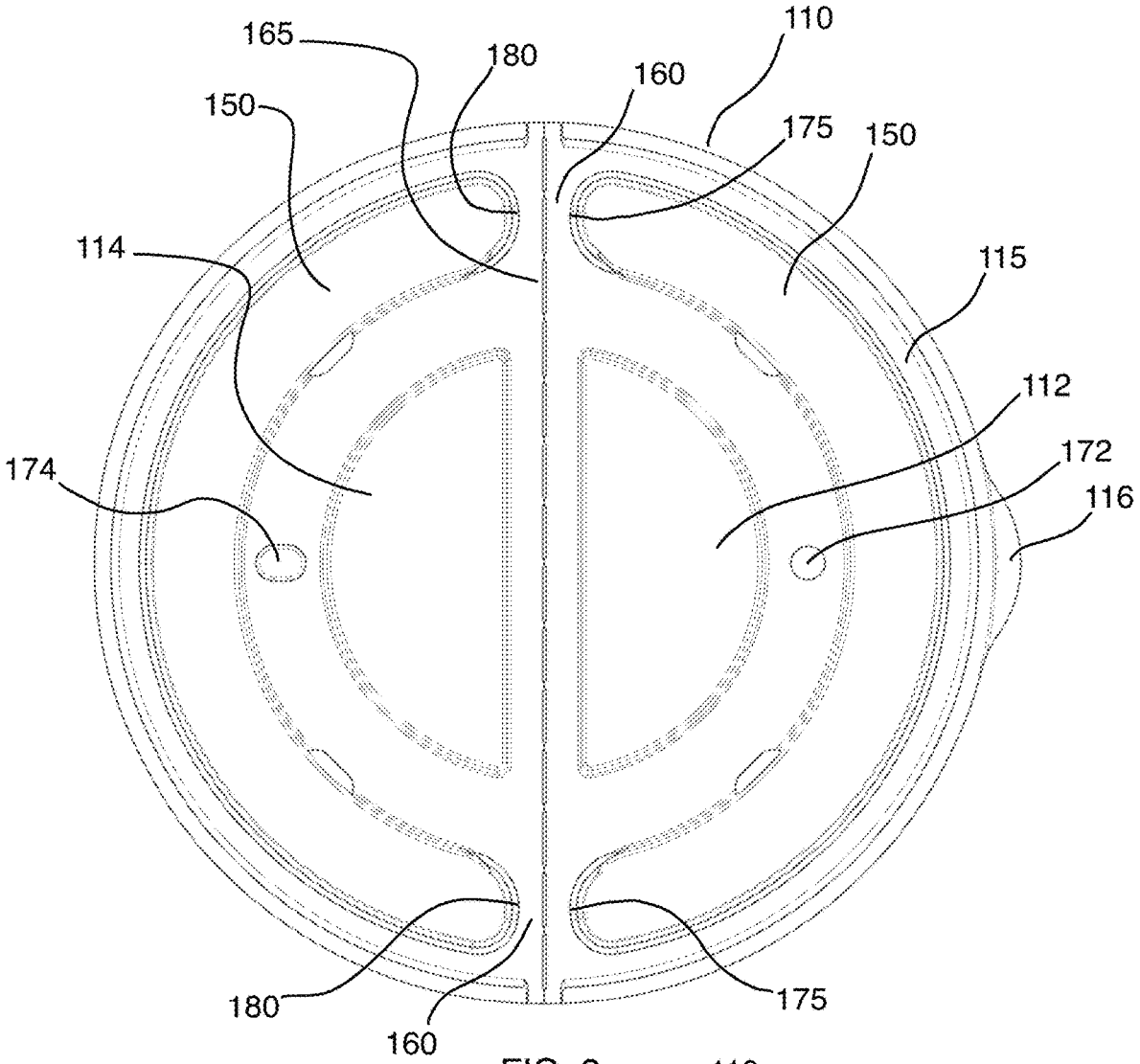
FIG. 3 is a plan view of the underside of the foldable lid of the container system of FIG. 1, according to at least one illustrated implementation.
Figure 4:
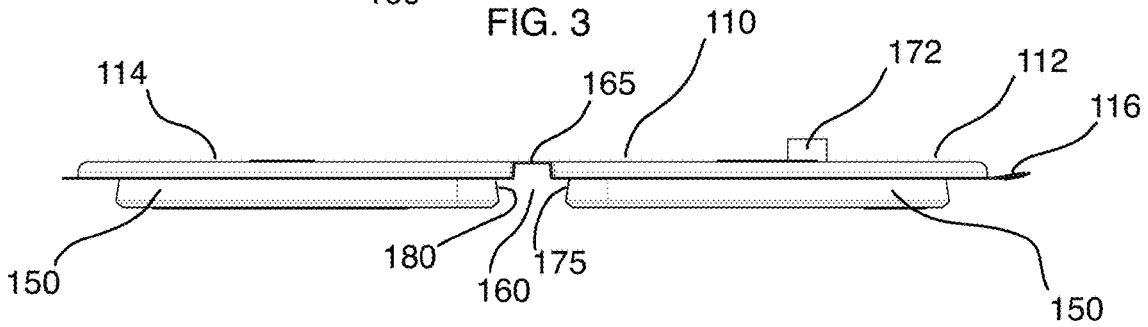
FIG. 4 is a side edge view of the foldable lid of the container system of FIG. 1, according to at least one illustrated implementation.

FIG. 3 is a plan view of the underside of the foldable lid 110 of the container system 100. FIG. 4 is a side edge view of the foldable lid 110. The lid 110 has a peripheral outer rim 115 to meet, e.g., couple with, the rim 135 of the base 120. In embodiments, the outer rim 115 may contact, or nearly contact, the rim 135 of the base 120 (e.g., the top or inside of the rim 135), as opposed to coupling by having a shape which corresponds to and/or conforms to the shape of the rim 135 of the base 120. The lid 110 has a pair of partial peripheral troughs 150 positioned radially inward of the outer rim 115. The ends of the partial peripheral troughs 150 are spaced apart along a perimeter of the lid 110 to form a pair of peripheral gaps 160 on opposite sides of the lid 110. In the example depicted, because the container is substantially circular, the partial peripheral troughs 150 may be referred to as partial-circumferential troughs, in which case the ends of the partial-circumferential troughs 150 would be described as circumferentially spaced apart to form a pair of circumferential gaps 160 on opposite sides of the lid 110.

The peripheral gaps 160 receive respective ones of the pair of protrusions 140 of the base 120 to attach the lid 110 to the base 120, as discussed in further detail below. The lid 110 has a hinge 165 about which it folds as a first part 112 of the lid 110 (e.g., a half-section of the lid 110 having a lifting tab) is lifted to provide access to the interior volume of the base 120, while a second part 114 of the lid 110 (e.g., the remaining half-section of the lid 110) on an opposite side of the hinge 165 remains attached to the base 120. The hinge 165 may extend across a width of the lid 110 in alignment with the pair of peripheral gaps 160. The hinge 165 is depicted in the drawings as a single dashed line for the sake of clarity. However, in embodiments, the hinge 165 may comprise one or more fold lines and/or various other features to provide a well-controlled folding operation, as described in further detail below.

In embodiments, the hinge 165 may be implemented by a number of different methods and/or geometric arrangements, some of which are common in the field. In general, the techniques are aimed at weakening a defined folding area (e.g., a linear area) enough to allow for a controlled and repeatable folding or swing action. For example, a hinge may be formed by scoring one or more cuts, partial cuts, and/or scratches on the surface of the lid to weaken the folding area without causing a complete separation of the original geometry. Such scoring techniques typically do not involve a fully-penetrating cutting operation but, rather, leave some material thickness intact which provides hinge-like functionality. Another approach to providing a controlled and repeatable folding or swing action involves punching a series of cuts that are arranged in a collinear fashion and separated from each other by uncut material. A hinge formed in this manner may have one or more such perforated pattern features, which may include complete cut-through perforations, partially cut-through perforations, or a combination of the two. Another approach to providing a controlled and repeatable folding or swing action is to weaken a defined hinge area by forming one or more parallel grooves. The formed groove or grooves tend to weaken the defined folding area to make it more flexible and easy to bend. This type of an unscored or unperforated hinge feature is often known in the field as a "living hinge."

The lid 110 may have a lock to removably attach the first part 112 of the lid 110 to the second part 114 of the lid 110 when the lid 110 is folded to a position in which a top surface of the first part 112 of the lid 110 meets a top surface of the second part 114 of the lid 110. The lock may have an upward protrusion 172 on either the first part 112 or the second part 114 of the lid 110 and an indent 174 to receive the upward protrusion 172 on the other part of the lid 110.

The pair of protrusions 140 of the base 120 form interference fits (e.g., snap fits) with the pair of peripheral gaps 160 of the lid 110 form to attach the lid 110 to the base 120. The first part 112 of the lid 110 and the second part 114 of the lid 110 each independently form an interference fit with the pair of protrusions 140 of the base 120 to attach the lid 110 to the base 120. Specifically, the first part 112 of the lid 110 forms an interference fit with a first portion of the rim 135 of the base 120 and the pair of protrusions 140 of the base 120, and the second part 114 of the lid forms an interference fit with a second portion of the rim 135 of the base 120 and the pair of protrusions 140 of the base 120. Therefore, as one part of the lid 110 (e.g., the first part 112) is lifted to provide access to the interior volume of the base 120, the other part of the lid 110 (e.g., the second part 114) remains attached to the base 120.

Each gap of the pair of peripheral gaps 160 of the lid 110 has a first side surface 175 and an opposing second side surface 180 which are sized and shaped so that each protrusion of the pair of protrusions 140 of the base 120 forms an interference fit with both the first side surface 175 and the second side surface 180 of a respective one of the pair of peripheral gaps 160 when the lid 110 is attached to the base 120. When the lid 110 folds as, e.g., the first part 112 of the lid 110 is lifted to provide access to the interior volume of the base 120, the first side surface 175 of each gap loses contact with a respective one of the pair of protrusions 140 of the base 120, while the second side surface 180 of each gap maintains an interference fit with the respective one of the pair of protrusions 140 of the base 120.

In implementations, as shown in the view of FIG. 3, the underside of the lid 110 includes two wide semi-circular and downwardly extending portions (e.g., partial circumferential troughs 150) dimensioned to form an interference fit inside of the rim 135 of the base 120. The lid 110 also includes two outward and narrower semi-circular portions (e.g., peripheral outer rim 115), concentric with the wider portions (e.g., partial circumferential troughs 150), which press fit along the periphery (e.g., the rim 135) of the base 120 to provide a secure fit. Gaps (e.g., pair of circumferential gaps 160) are positioned between the semi-circular portions (e.g., partial circumferential troughs 150) to receive each boss (e.g., pair of protrusions 140) of the base 120.

In implementations, the lid 110 may have at least one enlarged overhang portion, e.g., tab 116, to provide a gripping region to facilitate separation from the base 120 of the portion of the lid 110 including the tab 116 (e.g., the first part 112 of the lid 110). As discussed above, one section of the lid 110 (e.g., the first part 112 of the lid 110) may include a boss or protrusion (e.g., upward protrusion 172) and the other section may include a recess (e.g., indent 174), such that when one section of the lid 110 is completely opened, it can be pressed against the closed section of the lid 110, whereupon the boss and recess mate to maintain positioning of the opened section.

Figure 5A:
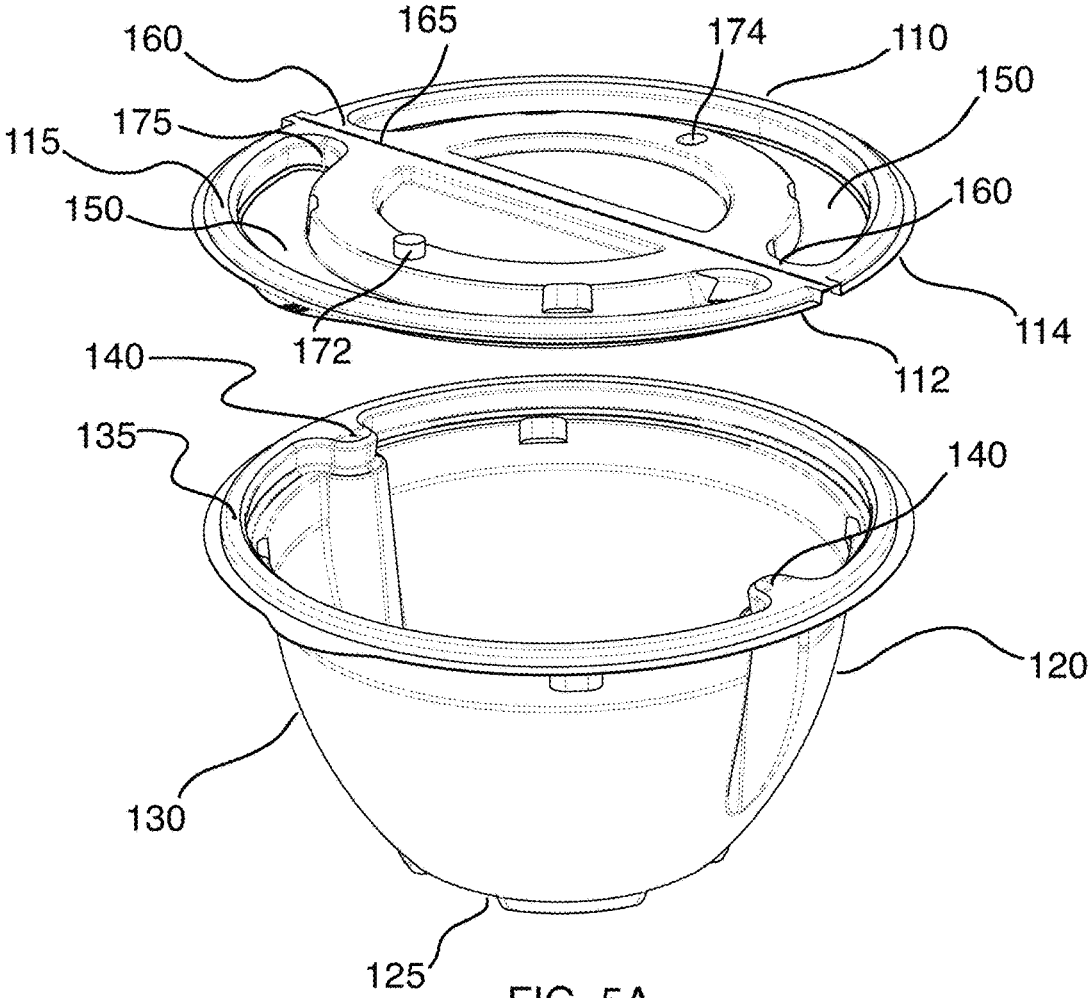
FIG. 5A is a perspective view of a container system having a foldable lid showing the lid unattached to the base, according to at least one illustrated implementation.
Figure 5B:
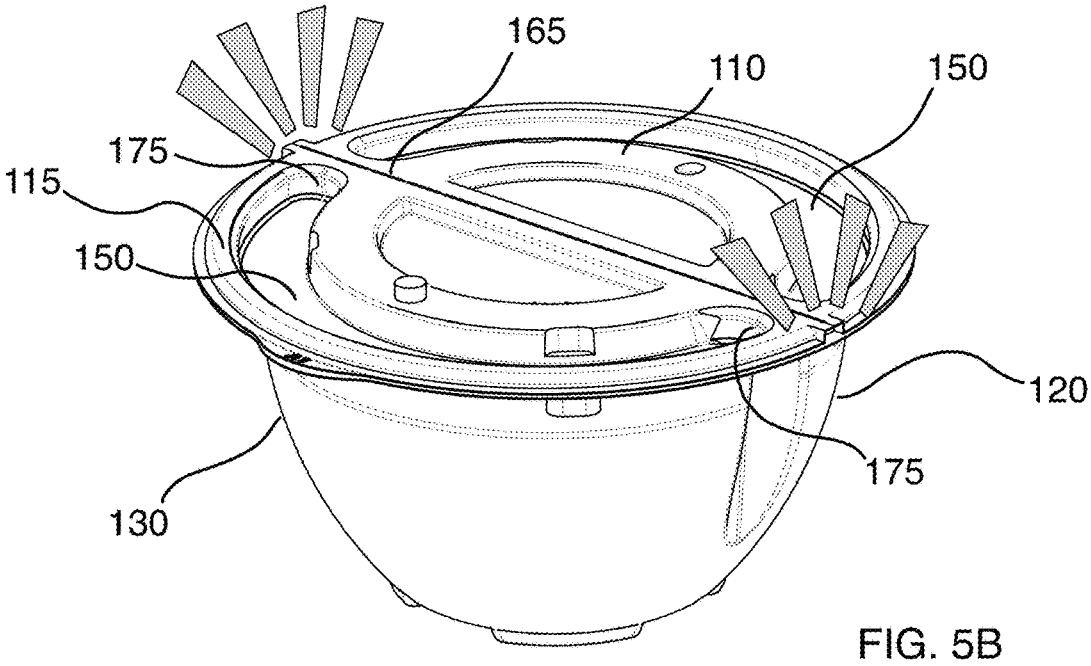
FIG. 5B is a perspective view of the container system of FIG. 5A showing the lid attached to the base, according to at least one illustrated implementation.
Figure 5C:
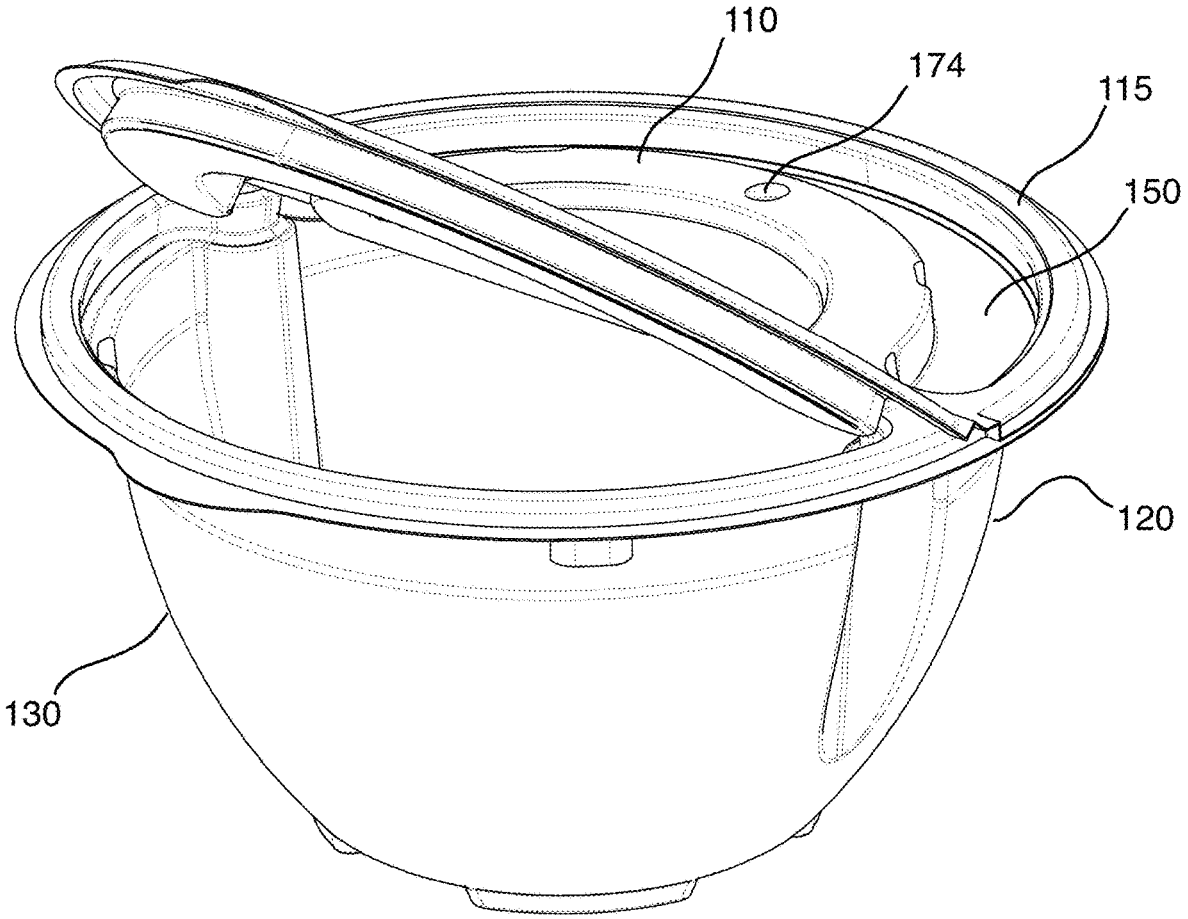
FIG. 5C is a perspective view of the container system of FIG. 5A showing the lid attached to the base and partially folded to provide access to an interior of the base, according to at least one illustrated implementation.

FIG. 5A is a perspective view of a container system 100 having a foldable lid 110 showing the lid 110 unattached to the base 120. FIG. 5B shows the lid 110 attached to the base 120, e.g., with a snap fit. FIG. 5C shows the lid 110 attached to the base 120 and partially open, i.e., folded, to provide access to an interior of the base 120. Thus, FIGS. 5A-5C show the base 120 and the lid 110 of the container system 100, i.e., container assembly, in assembled and disassembled states. FIG. 5A shows the base 120 and the lid 110 separated. FIG. 5B shows the entire lid in a closed position attached to the base 120. In this position, the lid 110 is press fit (e.g., snap fit) to the base 120 along an adjoining periphery (e.g., the pair of partial peripheral troughs 150 of the lid 110) and the opposing bosses (e.g., pair of protrusions 140) of the rim 135 of the base 120. FIG. 5C shows that a portion of the lid 110 (e.g., the first part 112 of the lid 110) has been opened by pivoting the lid 110 about its hinge 165, while the remainder of the lid 110 (e.g., the second part 114 of the lid 110) remains attached to the base 120. Although a relatively deep base 120 is depicted, it will be readily appreciated that various sizes can be used for the base 120, including, for example, a shallower base 120 having the same opening dimensions.

Figure 6A:
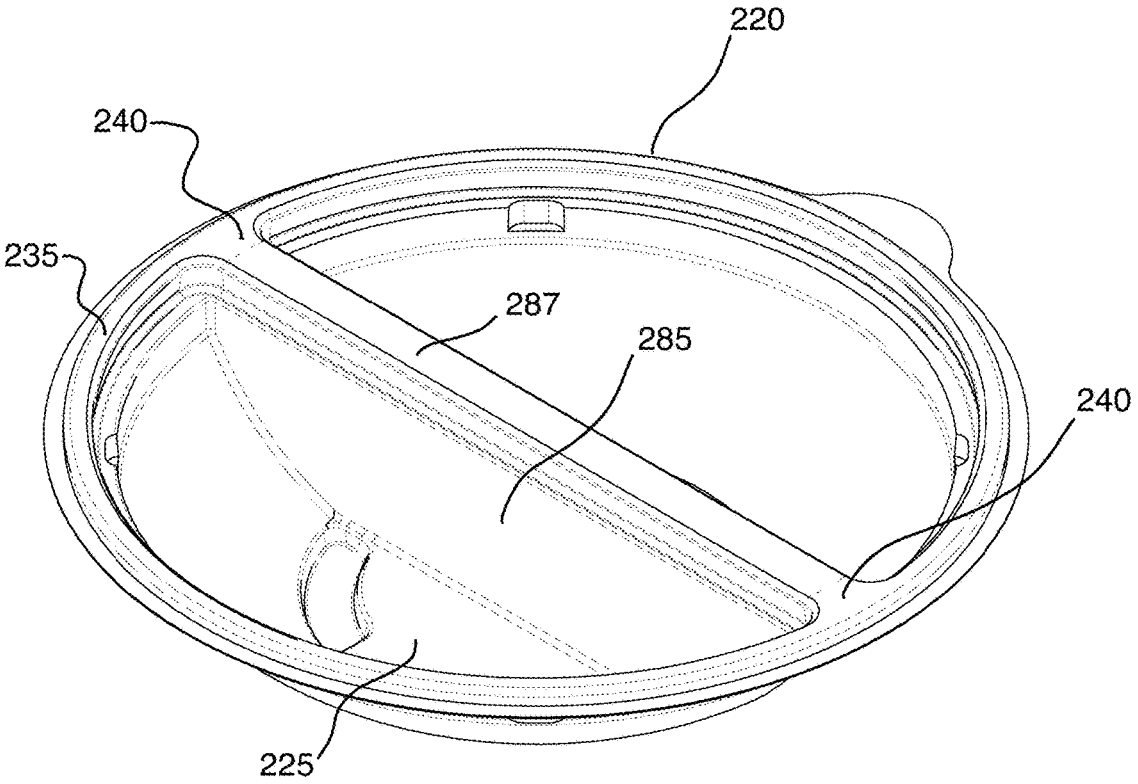
FIG. 6A is a perspective view of a base of a container system having a foldable lid, including a dividing wall to divide the base into sections, according to at least one illustrated implementation.
Figure 6B:
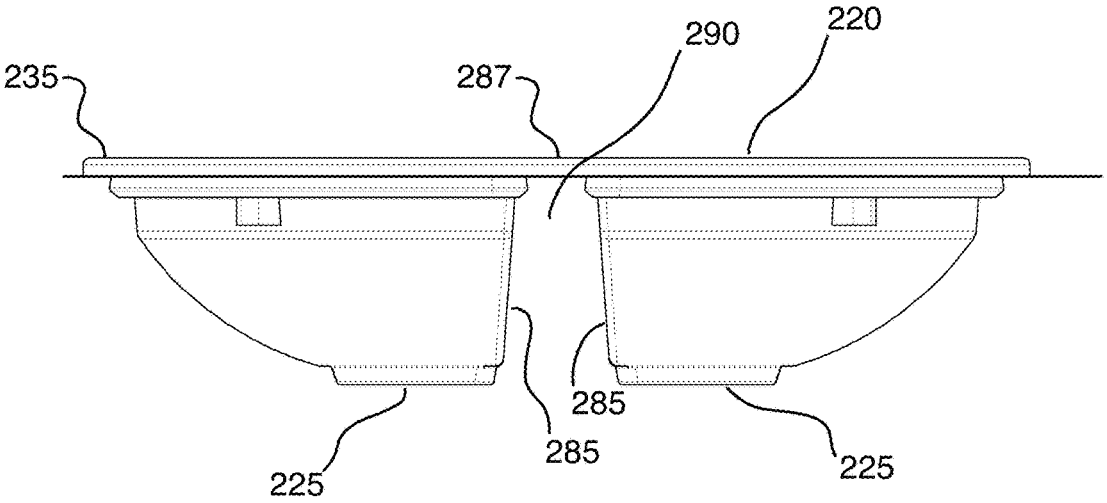
FIG. 6B is a side view of the base of the container system of FIG. 6A, including the dividing wall to divide the base into sections, according to at least one illustrated implementation.

FIG. 6A is a perspective view of a base 220 of a container system having a foldable lid 110 (not shown in this view) similar to the one discussed above (see, e.g., FIGS. 1, 3 and 4), the base 220 including a dividing wall 285 to divide the base 220 into sections. FIG. 6B is a side view of the base 220 divided into sections by the dividing wall 285. In implementations, the dividing wall 285 extends across a width of the base 220 between the pair of protrusions 240 of the rim 235 on opposite sides of the base 220. The dividing wall 285 may have a rim 287 which is continuous with the pair of protrusions 240 of the rim 235 on opposite sides of the base 220 and the rim 235 of the base 220. The dividing wall 285 may be in the form of a protrusion extending from a bottom 225 of the base 220 such that the base 220 is divided into two portions with a space 290 therebetween.

Thus, FIGS. 6A and 6B show an implementation in which the base 220 has a dividing wall 285 to form two separate compartments, such that different foods can be stored in each compartment. Either of the sections of the lid 110 can be opened to provide access to either of the compartments.

Figure 7:
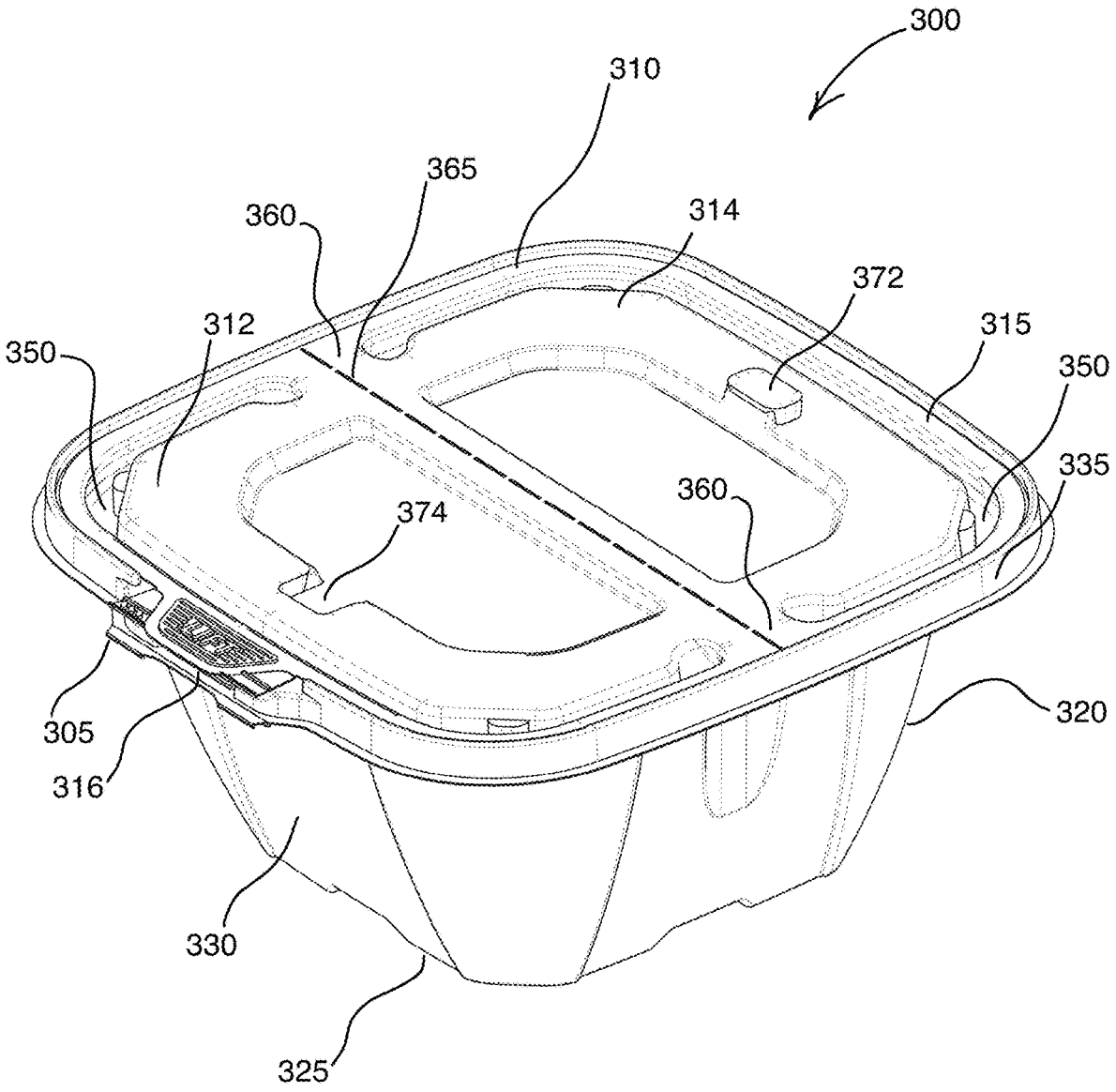
FIG. 7 is a perspective view of another embodiment of container system having a foldable lid connected to a base.
Figure 8:
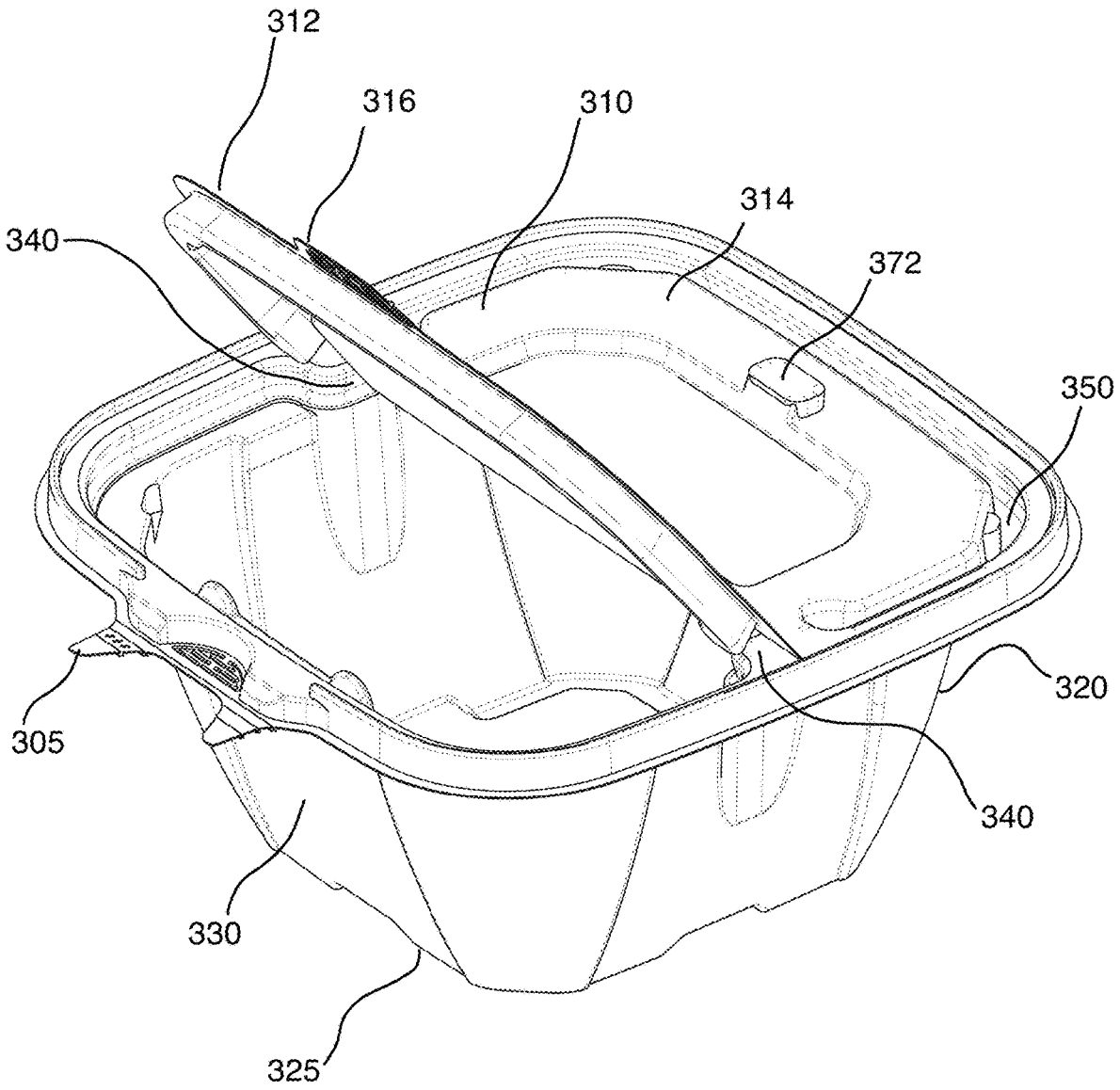
FIG. 8 is a perspective view of the container system of FIG. 7, with the lid in a partially opened position.
Figure 9:
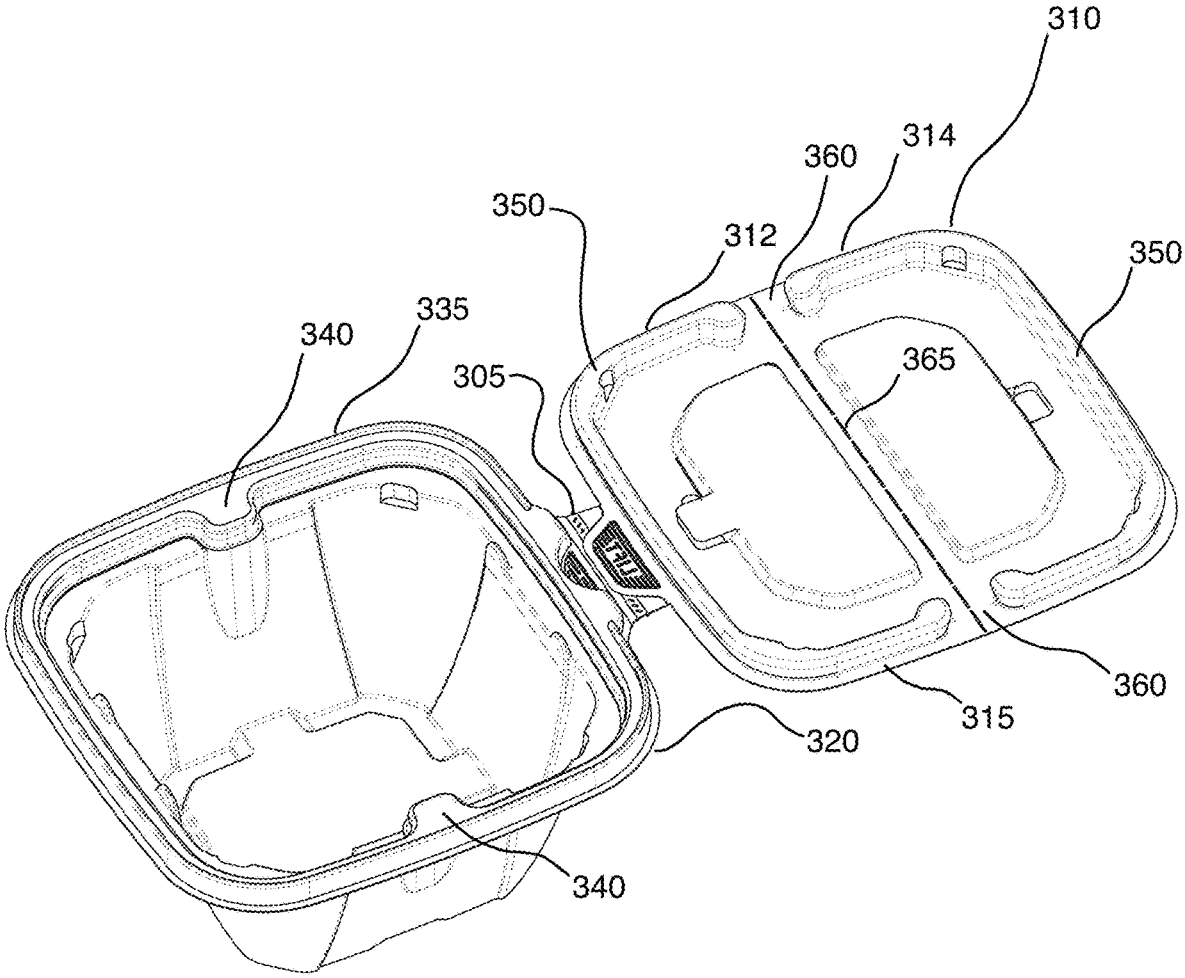
FIG. 9 is a perspective view of the container system of FIG. 7 in a pre-use state.
Figure 10:
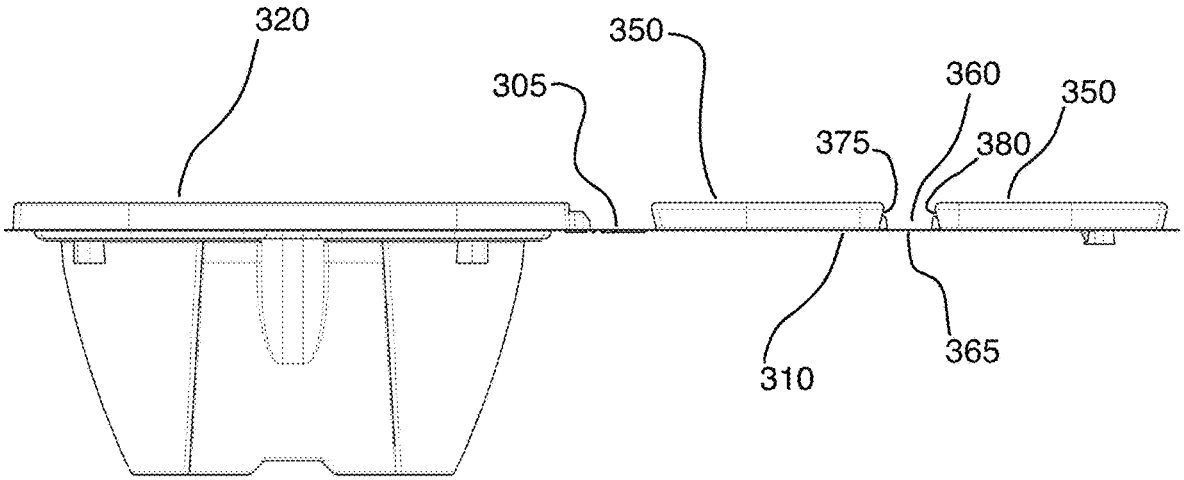
FIG. 10 is a side view of the container system of FIG. 7 in the pre-use state.

FIGS. 7-10 are views of a container system 300 having a foldable lid 310 connected to a base via a tamper-evident hinge 305. In FIG. 7, the lid 310 is folded about the tamper-evident hinge 305 and is attached to cover the base 320. In FIG. 8, the lid 310 is folded about the tamper-evident hinge 305 and attached to partially cover the base 320, and the lid 310 is partially folded about a lid hinge 365 to provide access to an interior of the base 320. In FIGS. 9 and 10, the lid 310 is unfolded about the tamper-evident hinge 305 in a pre-use state and attached to the base 320 at the tamper-evident hinge 305 to completely uncover the base 320. The tamper-evident hinge contains a break-away feature or perforation to provide access to a "lift" tab 316 when the container system is closed, as shown in FIG. 7. To access contents in the base 320 when closed, the break-away feature is opened, such as by a user sliding a finger below the lift tab 316 or pinching frangible portions on either side of the lift tab 316, thereby separating the tamper-evident hinge 305, or by directly pulling up on the lift tab 316 with enough force to separate the tamper-evident hinge 305. Thereafter, the lift tab 316 can be pulled in an upward direction to separate a portion of the lid 310 from the base 320, as explained in more detail below.

The base 320 has a bottom 325 and sidewalls 330 extending from the bottom 325 to define an interior volume. In the example depicted, the base 320 is substantially square and therefore can be said to have four sidewalls 330. As discussed above, other shapes for the base 320 are also possible, such as, for example, round, oval, or rectangular, with the lid 310 having a corresponding shape. The base 320 has a rim 335 at a peripheral upper edge of the sidewalls 330. The rim 335 has a pair of protrusions 340 on opposite sides of the base 320 extending into the base 320. The pair of protrusions 340 may extend along at least a portion of the sidewalls 330 toward the bottom 325 of the base 320. As in the embodiments discussed above, the base 320 may be made in a thermoforming process, in which case the mold used to form the base 320 may have convex formations on opposites sides which cause the formation of an indentation, from the exterior toward the interior, on each side of the base 320.

The lid 310 has a peripheral outer rim 315 to meet with the rim 335 of the base 320. In implementations, the outer rim 315 may have an edge with little or no extension in the horizontal plane which fits within an interior of the rim 335 of the base 320 (i.e., as opposed to being curved and nesting with a curved base rim). By virtue of the arrangement of the outer rim 315 of the lid 310 and rim 335 of the base 320, and the use of a frangible tamper-evident hinge 305, the container system 300 can provide an indication to the user that a container has been previously opened. The container system 300 can be stacked as single units with the lid 310 attached to the base 320, such that for use in deli counters, etc., separate stocking and storage of lids and bases is not required. In use, a container is filled with content and the lid 310 is folded about the tamper-evident hinge 305 and snapped closed along the rim 335 of the base 320.

The lid 310 has a pair of partial peripheral troughs 350 positioned radially inward of the outer rim 315. The ends of the partial peripheral troughs 350 are spaced apart to form a pair of peripheral gaps 360 on opposite sides of the lid 310. The peripheral gaps 360 receive respective ones of the pair of protrusions 340 of the base 320 to attach the lid 310 to cover the base 320. The lid 310 has a hinge 365 about which it folds as a first part 312 (e.g., a half-section of the lid 310 having a lifting tab) is lifted to provide access to the interior volume of the base 320, while a second part 314 of the lid 310 (e.g., the remaining half-section of the lid 310) on an opposite side of the hinge 365 remains attached to the base 320. The hinge 365 may extend across a width of the lid 310 in alignment with the pair of peripheral gaps 360. In embodiments, the hinge 365 may be implemented as a fold line, multiple fold lines, or using any of the other approaches discussed above with respect to FIG. 3.

The lid 310 may have a lock to removably attach the first part 312 of the lid 310 to the second part 314 of the lid 310 when the lid 310 is folded to a position in which a top surface of the first part 312 of the lid 310 meets a top surface of the second part 314 of the lid 310. The lock may have an upward protrusion 372 on either the first part 312 or the second part 314 of the lid 310 and an indent 374 to receive the upward protrusion 372 on the other part of the lid 310.

The pair of protrusions 340 of the base 320 form interference fits (e.g., snap fits) with the pair of peripheral gaps 360 of the lid 310 to attach the lid 310 to the base 320. The first part 312 of the lid 310 and the second part 314 of the lid 310 each independently form an interference fit with the pair of protrusions 340 of the base 320 to attach the lid 310 to the base 320. Specifically, the first part 312 of the lid 310 forms an interference fit with a first portion of the rim 335 of the base 320 and the pair of protrusions 340 of the base 320, and the second part 314 of the lid forms an interference fit with a second portion of the rim 335 of the base 320 and the pair of protrusions 340 of the base 320.

Therefore, as one part of the lid 310 (e.g., the first part 312) is lifted to provide access to the interior volume of the base 320, the other part of the lid 310 (e.g., the second part 314) remains attached to the base 320.

Each gap of the pair of peripheral gaps 360 of the lid 310 has a first side surface 375 and an opposing second side surface 380 which are sized and shaped so that each protrusion of the pair of protrusions 340 of the base 320 forms an interference fit with both the first side surface 375 and the second side surface 380 of a respective one of the pair of peripheral gaps 360 when the lid 310 is attached to the base 320. When the lid 310 folds as, e.g., the first part 312 of the lid 310 is lifted to provide access to the interior volume of the base 320, the first side surface 375 of each gap loses contact with a respective one of the pair of protrusions 340 of the base 320, while the second side surface 380 of each gap maintains an interference fit with the respective one of the pair of protrusions 340 of the base 320.

In implementations, the lid 310 may have at least one enlarged overhang portion, e.g., lift tab 316, to provide a gripping region to facilitate separation from the base 320 of the portion of the lid 310 including the tab 316 (e.g., the first part 312 of the lid 310). In lifting the tab 316, perforated portions of the tamper-evident hinge 305 will be torn, thereby breaking a frangible connection between the lid 310 and the base 320 at the tamper-evident hinge 305. In alternative embodiments which do not require tamper-evident features, a tab 316 may extend from the second part 314 of the lid 310 instead of the first part 312, in which case the hinge 305 will remain intact when the tab 316 is used to separate a portion of the lid 310 from the base 320.

The various embodiments described above can be combined and/or modified to provide further embodiments in light of the above-detailed description, including the material incorporated by reference. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

What is claimed is:

1. A container system, comprising:

a base having a bottom and one or more sidewalls extending from the bottom to define an interior volume, the base having a rim at a peripheral edge of the one or more sidewalls, the rim having a pair of protrusions on opposite sides of the base extending into the base; and a lid having a peripheral outer rim, the lid comprising a pair of partial peripheral troughs positioned radially inward of the outer rim, ends of the partial peripheral troughs being spaced apart to form a pair of peripheral gaps on opposite sides of the lid to receive respective ones of the pair of protrusions of the base to attach the lid to the base, the lid having a hinge about which the lid folds as a first part of the lid is lifted to provide access to the interior volume of the base while a second part of the lid on an opposite side of the hinge remains attached to the base.

2. The container system of claim 1, wherein the hinge extends across a width of the lid in alignment with the pair of peripheral gaps.

3. The container system of claim 1, wherein the first part of the lid forms an interference fit with a first portion of the rim of the base and the pair of protrusions of the base, and the second part of the lid forms an interference fit with a second portion of the rim of the base and the pair of protrusions of the base.

4. The container system of claim 1, wherein the pair of protrusions of the base extend along at least a portion of the one or more sidewalls toward the bottom of the base.

5. The container system of claim 1, wherein each gap of the pair of peripheral gaps of the lid comprises a first side surface and an opposing second side surface which are sized and shaped so that each protrusion of the pair of protrusions of the base forms an interference fit with both the first side surface and the second side surface of a respective one of the pair of peripheral gaps when the lid is attached to the base.

6. The container system of claim 5, wherein when the lid folds as the first part of the lid is lifted to provide access to the interior volume of the base, the first side surface of each said gap of the pair of peripheral gaps loses contact with a respective one of the pair of protrusions of the base, while the second side surface of each said gap of the pair of peripheral gaps maintains an interference fit with the respective one of the pair of protrusions of the base.

7. The container system of claim 1, wherein the lid comprises a lock to removably attach the first part of the lid to the second part of the lid when the lid is folded to a position in which a top surface of the first part of the lid meets a top surface of the second part of the lid.

8. The container system of claim 7, wherein the lock comprises an upward protrusion on one of the first part of the lid and the second part of the lid and an indent to receive the protrusion on the other of the first part of the lid and the second part of the lid.

9. The container system of claim 1, wherein the base is a substantially round or substantially oval bowl formed of plastic and the lid has a corresponding round or oval shape and is formed of plastic.

10. The container system of claim 1, wherein the base is substantially rectangular or substantially square and is formed of plastic and the lid has a corresponding substantially rectangular or substantially square shape and is formed of plastic.

11. The container system of claim 1, further comprising a dividing wall to divide the base into sections, the dividing wall extending across a width of the base between the pair of protrusions of the rim on opposite sides of the base.

12. The container system of claim 11, wherein the dividing wall comprises a rim which is continuous with the pair of protrusions of the rim on opposite sides of the base and the rim of the base and the wall is formed at least in part by a protrusion extending from a bottom of the base which divides the base into two portions with a gap therebetween.

13. A container system, comprising:

a base having a bottom and one or more sidewalls extending from the bottom to define an interior volume, the base having a rim at a peripheral edge of the one or more sidewalls, the rim having a pair of protrusions on opposite sides of the base extending into the base; and a lid having a peripheral outer rim, the lid having a first part and a second part divided by a hinge about which the lid folds, the first part of the lid and the second part of the lid each independently forming an interference fit with the pair of protrusions of the base to attach the lid to the base so that as one of the first part and the second part of the lid is lifted to provide access to the interior volume of the base, the other of the first part and the second part of the lid remains attached to the base.

14. The container system of claim 13, wherein the first part of the lid forms an interference fit with a first portion of the rim of the base and the pair of protrusions of the base, and the second part of the lid forms an interference fit with a second portion of the rim of the base and the pair of protrusions of the base.

15. The container system of claim 14, wherein the first part of the lid forms an interference fit with one side of each protrusion of the pair of protrusions of the base, and the second part of the lid forms an interference fit with an opposite side of each protrusion of the pair of protrusions of the base.

16. The container system of claim 13, wherein the lid comprises a lock to removably attach the first part of the lid to the second part of the lid when the lid is folded to a position in which a top surface of the first part of the lid meets a top surface of the second part of the lid.

17. The container system of claim 16, wherein the lock comprises an upward protrusion on one of the first part of the lid and the second part of the lid and an indent to receive the protrusion on the other of the first part of the lid and the second part of the lid.

18. The container system of claim 13, wherein the pair of protrusions of the base extend along at least a portion of the one or more sidewalls toward the bottom of the base.

19. The container system of claim 13, wherein the base is a substantially round or substantially oval bowl formed of plastic and the lid has a corresponding round or oval shape and is formed of plastic.

20. The container system of claim 13, wherein the base is substantially rectangular or substantially square and is formed of plastic and the lid has a corresponding substantially rectangular or substantially square shape and is formed of plastic.

* * * * *